US009226568B2

(12) United States Patent
Gafford et al.

(10) Patent No.: US 9,226,568 B2
(45) Date of Patent: Jan. 5, 2016

(54) FLEXIBLE WIRE BRISTLE BRUSH WITH INCREASED DURABILITY

(71) Applicant: W.C. BRADLEY CO., Columbus, GA (US)

(72) Inventors: Alex Gafford, Midland, GA (US); Mallik Ahmed, Columbus, GA (US)

(73) Assignee: W.C. Bradley Co., Columbus, GA (US)

( * ) Notice: Subject to any disclaimer, the term of this patent is extended or adjusted under 35 U.S.C. 154(b) by 0 days.

(21) Appl. No.: 14/530,272

(22) Filed: Oct. 31, 2014

(65) Prior Publication Data

US 2015/0150364 A1 Jun. 4, 2015

Related U.S. Application Data

(60) Provisional application No. 61/911,103, filed on Dec. 3, 2013.

(51) Int. Cl.

| | |
|---|---|
| ***A46B 3/00*** | (2006.01) |
| ***A46B 7/00*** | (2006.01) |
| ***A46B 9/12*** | (2006.01) |
| ***A46D 1/00*** | (2006.01) |

(52) U.S. Cl.

CPC ... *A46B 3/00* (2013.01); *A46B 7/00* (2013.01); *A46B 9/12* (2013.01); *A46D 1/0207* (2013.01); *A46B 2200/3093* (2013.01)

(58) Field of Classification Search

CPC ..... A46B 3/00; A46B 7/00; A46B 9/12; A46B 2200/3093

See application file for complete search history.

(56) References Cited

U.S. PATENT DOCUMENTS

| | | | | |
|---|---|---|---|---|
| 499,678 | A * | 6/1893 | Long | 15/168 |
| 1,082,497 | A * | 12/1913 | Case | 15/168 |
| 1,476,083 | A * | 12/1923 | Kett | 15/168 |
| 1,903,520 | A | 4/1933 | Sturgis | |
| 2,769,192 | A | 11/1956 | Satzinger | |

FOREIGN PATENT DOCUMENTS

| | | |
|---|---|---|
| DE | 2727292 | 1/1979 |
| GB | 681606 | 10/1952 |

OTHER PUBLICATIONS

PCT International Search Report and Written Opinion; Feb. 12, 2015; US.

* cited by examiner

*Primary Examiner* — Randall Chin

(74) *Attorney, Agent, or Firm* — Dennis D. Brown; Brown Patent Law, PLLC

(57) ABSTRACT

A brush having bundles of wire bristles which extend from a retaining base wherein the brush also includes deflection support guides for the bundles with openings which surround and contact the active portions of the bundles when the bundles flex during use.

4 Claims, 7 Drawing Sheets

FLEXIBLE WIRE BRISTLE BRUSH WITH INCREASED DURABILITY

RELATED CASE

This application claims the benefit of U.S. Provisional Patent Application Ser. No. 61/911,103 filed on Dec. 3, 2013 and incorporates said provisional application by reference into this document as if fully set out at this point.

FIELD OF THE INVENTION

The present invention relates to wire bristle brushes used for cleaning cooking grates in outdoor grills and for other purposes including, but not limited to, cleaning rust, removing paint, removing welding slag, and cleaning automotive battery posts.

BACKGROUND OF THE INVENTION

A need exists for an improved wire bristle brush which (a) has an active bristle length which provides desirable flexibility for cleaning non-uniform structures such as cooking grates, (b) has a significantly longer life, and (c) significantly reduces or substantially prevents bristle breakage and loss during use.

For outdoor cooking grills, the cleaning of the cooking grate or grate assembly that supports the food during cooking is a matter of continual concern. After cooking, the user will want to remove any partially cooked food debris and/or char that remains on the surfaces of the food support structure so that the debris will not contaminate or alter the flavor, aroma, or other characteristics of the subsequently cooked food items.

Many methods and devices have been proposed over the years for cleaning outdoor cooking grates, including wipers, scrapers, and brushes. Wire bristle brushes are commonly preferred because the bundles of wire bristles which project from the brush have a length and flexibility which are more effective for reaching and abrasively cleaning the irregular surfaces, apertures, and/or other hard-to-clean features typically encountered in cooking grates. Fixed scrapers and other implements often cannot reach and/or cannot provide a sufficient amount of abrasive force for quickly cleaning such surfaces and features. Metallic wires are also preferred due to their suitability for contacting warm or hot cooking grate surfaces.

Brushes having wire bristles formed of stainless steel, brass, steel, aluminum, titanium and other metals are known in the art. The brushes used for cleaning cooking grates typically have wire bristles of from about 0.005 to about 0.010 inch in diameter which are formed of stainless steel or brass and are gathered together in bundles of from about 50 to about 100 bristles. Each bundle is typically attached to a base retaining structure formed of wood or plastic by gathering the wire bristles tightly together and punching the bundle into the outer surface of the base, in much the same manner that a stapler inserts each point of a staple into a blind hole.

To ensure that the wire bristle bundle is of sufficient length for both (a) insertion of a base end portion into the base retaining structure and (b) the subsequent intended use of the brush, the overall length of each bundle prior to insertion into the base will typically be at least twice the active bristle length required for the intended use. As used herein and in the claims, the term "active length" means the projecting part of a bristle or a bundle which will flex under load during use. The "active length" of the bristle or bundle extends from an initial bend point of the bristle or bundle to the distal end of the bristle or bundle. The initial bend point of each bristle or bundle under load is typically located at or substantially at the outer surface of the base structure. Typically, the active length of the bristle bundle projecting from the base will be in the range of from about 0.5 to about 1.0 inches.

A significant shortcoming of the current art is that, for brushes having a sufficient flexible active bristle length for cleaning cooking grates or other structures of similar complexity, the repeated flexing of the bristles under the force load required for such use will exceed the endurance limit of the bristles, thus resulting in the premature failure, breakage, and loss of a significant number of individual brush bristles over time.

Given the size of a typical brush, the size of a typical grill, and the number of times the grill is used per year, the cleaning brush can accumulate several tens of thousands of back and forth brush stroke cycles in the course of several years. Materials such as stainless steel and brass have endurance limits related to these back and forth movements under load which are only a fraction of the ultimate tensile strength of the material. As illustrated in FIG. 1, when used at load and stress levels which are below this endurance limit, the material will normally have a life of at least 10 million fully reversed (i.e., back and forth) stress cycles. However, as also illustrated in FIG. 1, if the stress level to which the brush bristles are exposed is higher than the endurance limit, then the brush bristles will have a shorter, finite life which declines exponentially (per the logarithmic Cycles scale used in FIG. 1) as the stress level is further increased.

SUMMARY OF THE INVENTION

The present invention provides a wire bristle brush which satisfies the needs and alleviates the problems discussed above. The inventive brush (a) provides the flexible active bristle length needed for cleaning cooking grates and other structures of similar complexity, (b) prevents the wire bristles and the bristle bundles from being stressed beyond their endurance limit, (c) significantly increases the durability and useful life of the brush, and (d) significantly reduces or substantially prevents the breakage and loss of bristles over the extended useful life of the brush. Also, the inventive wire bristle brush is not limited to use for cleaning cooking grates. Rather, the inventive brush is well suited for all services in which wire bristle brushes are used, particularly services involving high force loads and stresses.

In one aspect, there is provided a wire bristle brush which preferably comprises: (a) a retaining base; (b) one or more bundles of wire bristles, each bundle comprising a proximal end portion which is retained in fixed position by the retaining base and a projecting active portion having an active length which extends longitudinally from an initial bend point of the bundle to a distal end of the bundle; and (c) a deflection support guide for each bundle comprising a support guide opening through which the bundle projects. The support guide opening has a longitudinally outermost contacting perimeter which surrounds the bundle for contacting the active portion of the bundle when the bundle flexes during use. The longitudinally outermost contacting perimeter of the support guide opening is spaced longitudinally outward from the initial bend point of the bundle a longitudinal distance which is preferably in the range of from about 25% to about 67% of the active length of the bundle. In addition, the support guide opening area at the longitudinally outermost contacting perimeter is preferably from about 150% to about 700% larger than the cross-sectional area of the bundle at the initial bend point.

Further aspects, features, and advantages of the present invention will be apparent to those of ordinary skill in the art upon examining the accompanying drawings and upon reading the following Detailed Description of the Preferred Embodiments.

DETAILED DESCRIPTION OF THE PREFERRED EMBODIMENTS

Figure 1:
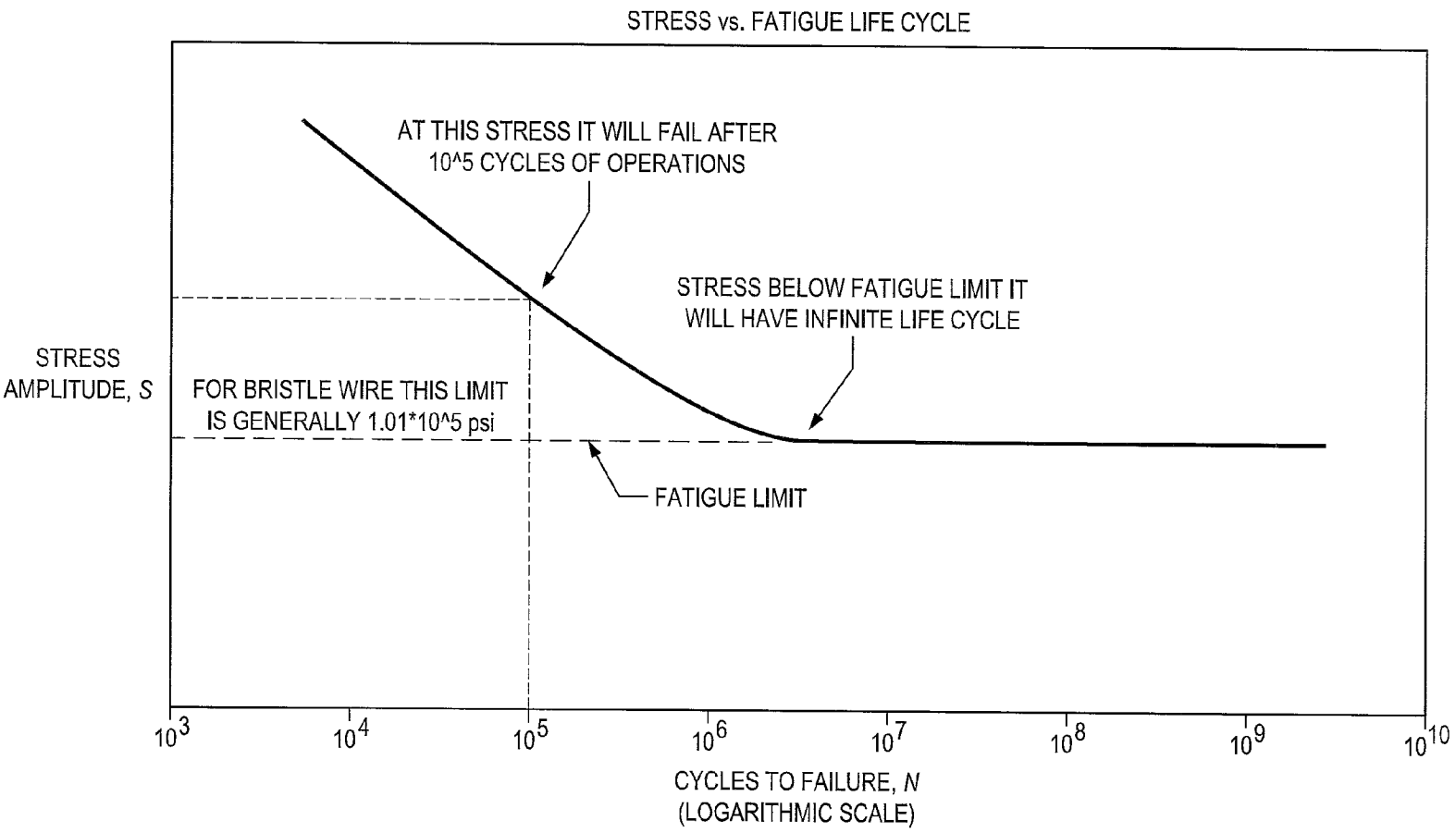
FIG. 1 is a chart showing the typical relationship between applied stress versus fatigue life for wire bristle brushes.

An embodiment 2 of the inventive wire bristle brush is shown in FIGS. 2-5. The inventive brush 2 comprises: a base piece 4; a plurality of bundles of wire bristles 6 which project from the outer surface 8 of the base piece 4; a guide plate 10 which is parallel to and spaced apart from the outer surface 8 of the base piece 4; and a pair of opposing end plates 12 and 14 which extend downwardly from the ends of the guide plate 10 and are attached to the corresponding ends 16 and 18 of the base piece 4 for retaining the guide plate 10 in spaced position above the outer surface 8 of the base piece 4.

The base piece 4 can be formed of wood, molded plastic, or other materials which have sufficient durability for the use in question and which are preferably capable of retaining the bundles of wire bristles over an extended period of use. For use in cleaning outdoor cooking grates, the base piece material will also preferable have sufficient heat resistance to withstand the temperature conditions encountered when cleaning outdoor grills.

Figure 2:
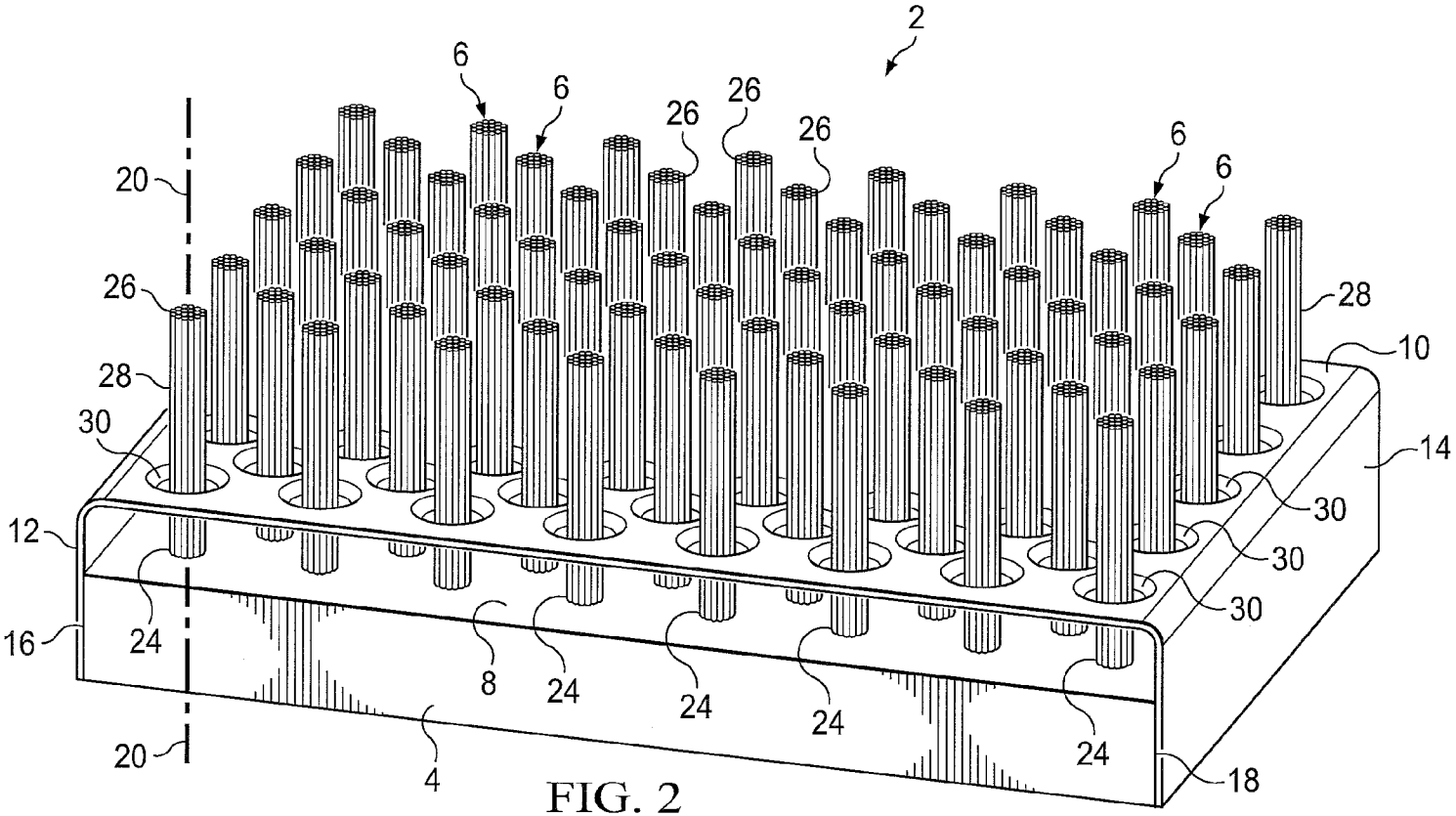
FIG. 2 is a perspective view of an embodiment 2 of the wire bristle brush provided by the present invention.
Figure 3:
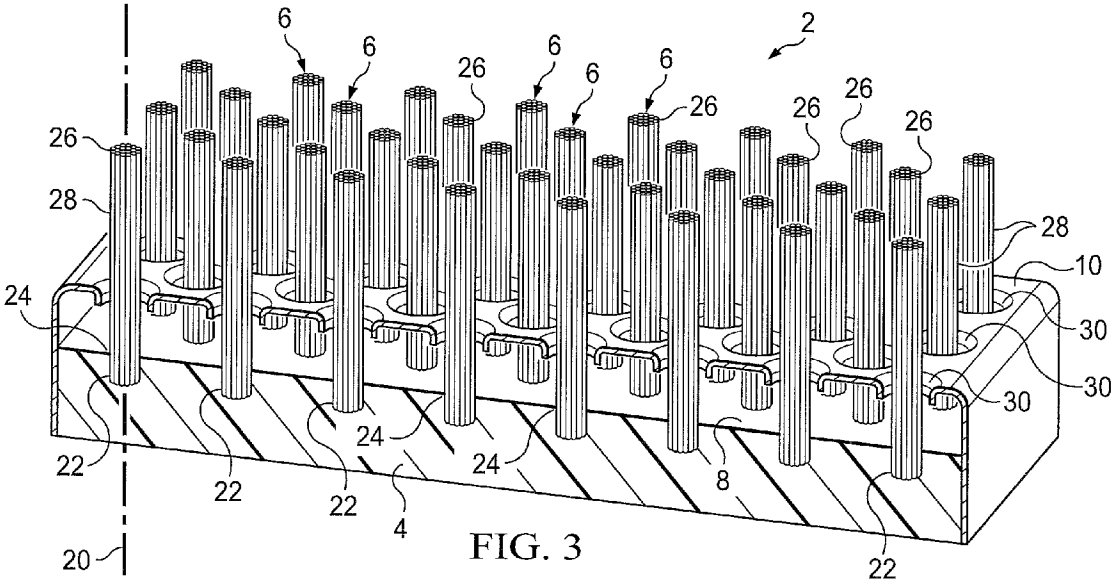
FIG. 3 is a cutaway perspective view of the inventive wire bristle brush 2.
Figure 4:
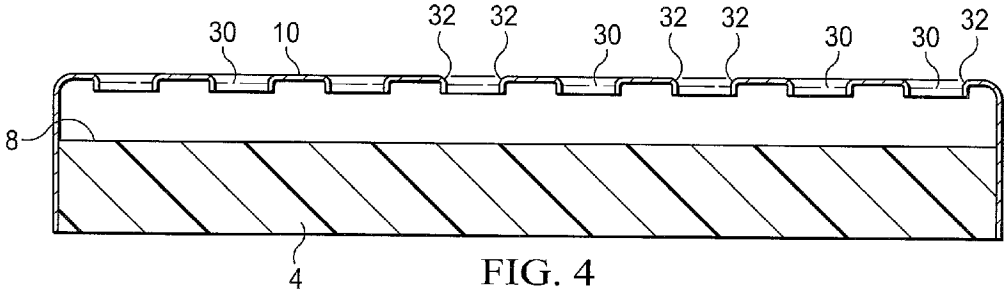
FIG. 4 schematically illustrates a cutaway elevational side view of a retaining base 4 and guide plate 10 assembly used in the inventive brush 2.

Although the base piece 4 is illustrated in FIGS. 2-3 as simply being in the form of a flat, rectangular block of material, it will be understood that the base piece 4 can be of a different shape and/or that the brush 2 or base piece 4 can include additional features. For example, the inventive brush 2 can also include a handle which extends from the base piece 4. Also, the brush 2 and the base piece 4 can have shapes ranging from long and thin to short and wide. Further, as another example, although the outer surface 8 of the base piece 4 is shown as being flat planar surface, the outer surface 8 could alternatively have a projecting convex curved shape or other shape. If the outer surface 8 of the base piece 4 has a convex curved shape or other curved shape, the guide plate 10 can optionally also have a curved shape corresponding or partially corresponding thereto.

Each bundle of wire bristles 6 has: a longitudinal axis 20; a base end portion (i.e., a proximal longitudinal end portion) 22 which is punched into a blind hole in the outer surface 8 of the base piece 4 or is otherwise received through the outer surface 8 and retained in fixed position by the base piece 4; an initial bend point 24 which is at or substantially at (e.g., slightly outside of) the outer surface 8 of the base 4; a longitudinal outer end (i.e., distal end) 26; and a projecting active flexing portion 28 having an active length which extends longitudinally from the initial bend point 24 to the distal end 26 of the bundle 6.

Each bundle 6 will preferably comprise from about 50 to about 100 bristles, each bristle preferably having a diameter of from about 0.005 to about 0.02 inch (more preferably from about 0.005 to about 0.01 inch). Each bundle 6 will also preferably have a cross-sectional area at the initial bend point 24 of from about 0.002 to about 0.013 $in^2$. The active length of each bundle 6 will preferably be in the range of from about 0.5 to about 1.5 inches.

It will also be understood that, although all of the bundles 6 shown in FIGS. 2 and 3 are of the same active length, the bundles 6 can alternatively have different active lengths. By way of example, but not by way of limitation, the bundles 6 could have different active lengths such that the outer ends 26 of the bundles 6 form an outwardly projecting convex curved shape. If the bundles 6 have different active lengths, the guide plate 10 can be planar or can have a shape corresponding or partially corresponding to the shape formed by the outer ends 26 of the bundles 6.

In the inventive brush 2, the bundles of wire bristles 6 extend through support guide openings 30 which are formed in the guide plate 10. The openings 30 provide deflection support for the bundles 6. In reference to the longitudinal axes 20 of the bundles 6, each support guide opening 30 has a longitudinally outermost contacting perimeter 32 which laterally surrounds the bundle 6 for contacting the active portion 28 of the bundle 6 when the bundle 6 flexes during use. The openings 30 preferably protrude a short distance toward the base 4 and the contacting perimeters 32 of the openings 30 are preferably smooth (e.g., rounded) to prevent the contact between the bundles 6 and the guide openings 30 from damaging the bristles.

Figure 6:
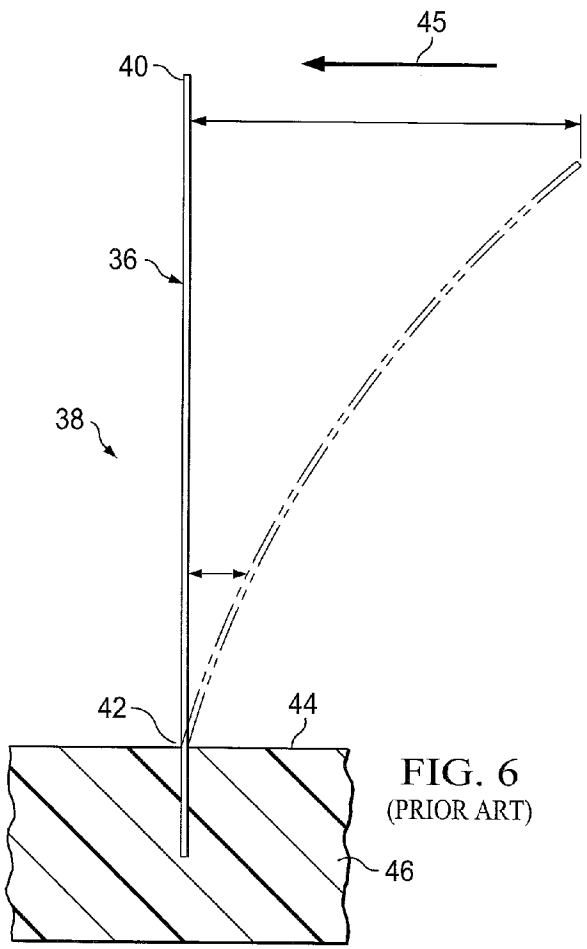
FIG. 6 (PRIOR ART)
FIG. 6 schematically illustrates the deflection behavior and characteristics of a bristle 36 of a prior art brush 38.
Figure 5:
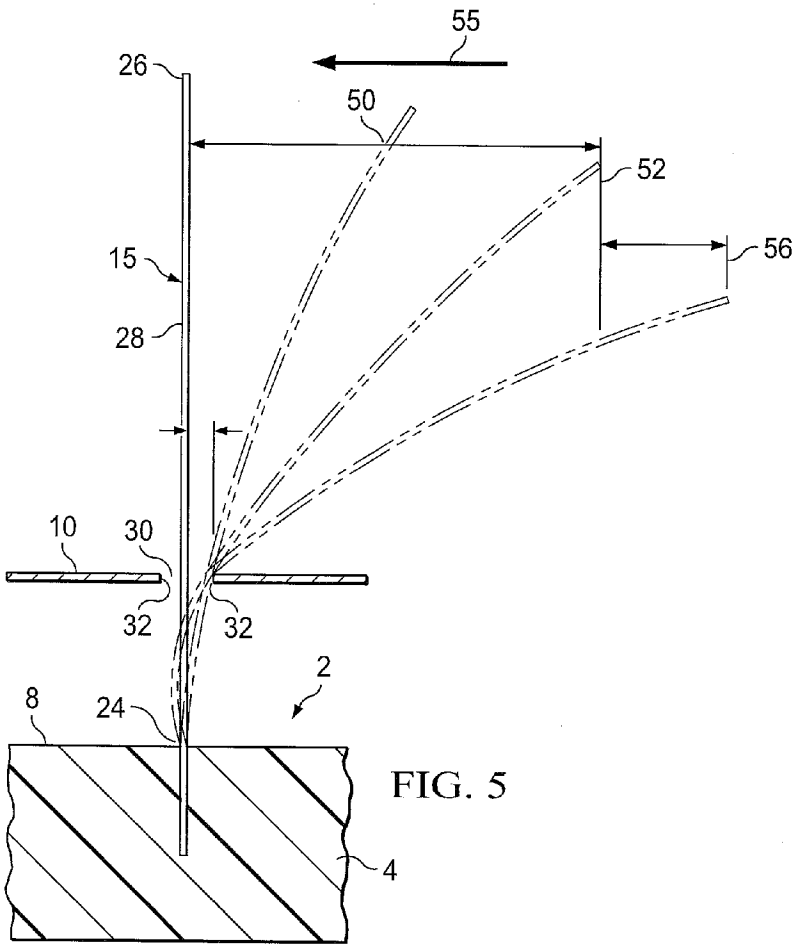
FIG. 5 schematically illustrates the deflection behavior and characteristics of a bristle 15 of the inventive brush 2.

The operation and benefits provided by the support guides 30 of the inventive brush 2 are illustrated in FIGS. 5 and 6. FIG. 6 illustrates the performance characteristics of a wire bristle 36 of a prior art brush 38 having no bundle support guide. When the prior art brush 38 is used for cleaning a cooking grate, the downward force (i.e., vertical load) and the back and forth scraping movement applied to the brush 38 deflect the tip 40 of the bristle 36 away from the current back or forth direction of travel 45 of the brush 38 such that the bristle 36 bends at an initial bend point 42 located substantially at the surface 44 of the retaining base 46. In the prior art brush 38, all of the bending moment forces acting on the bristle 36 during operation are concentrated at the initial bend point 42 such that, during normal use for cleaning a cooking grate, the stress level reached at the initial bend point 42 will exceed the endurance limit of the bristle 36.

In contrast, as illustrated in FIG. 5, the support guide 30 of the inventive brush 2 protects each wire bristle 15 such that, during normal or even extreme use, the endurance limit of the bristle 15 at its initial bend point 24 is not reached. Well prior to exceeding the endurance limit of the bristle 15, the bristle reaches an intermediate deflection point 50 where the bristle 15 contacts the contacting perimeter 32 of the support guide opening 30. As the outward deflection of the tip of the bristle 36 then continues toward a further deflection point 52 (i.e., a deflection point at which the endurance limit of the bristle 36 of the prior art brush 38 would be exceeded) the contact between the bristle 15 and the support guide opening 30 of the inventive brush 2 produces a stress reversal at the initial bend point 24 of the bristle 36. Consequently, rather than continuing to further bend at point 24 away from the current direction of back or forth travel 55 of the brush base 4, the bending direction of the bristle 36 at the initial bend point 24 reverses so that the bristle 36 is now bending slightly toward the direction of travel 55 at point 24. Moreover, at the same time, as the tip 26 of the bristle deflects to point 52 or deflects even further to the extreme deflection point 56, the additional bending moment force which this produces is at least primarily absorbed at the point of contact 32 between the bristle 15 and the support guide opening 30, rather than being added to the bending moment force acting at the initial bend point 24 of the bristle 15.

The size of the support guide openings 30 and the longitudinal spacing of the outermost contacting perimeters 32 of the openings 30 from the initial bend points 24 of the bristle bundles 6 will preferably be such that, due to (a) stress reversal at the initial bend point 24, (b) stress transfer to the guide contact point 32, (c) a combination thereof, and/or (d) other factors, the stress endurance limit of the bristles 15 will not be exceeded when a vertical load of up to about 10 pounds and a 2 inch repetitive back and forth motion are applied to the inventive brush 2.

In addition, the size of the openings 30 and the longitudinal spacing of the outermost contacting perimeters 32 of the openings 30 will also preferably be such that, under these same conditions, as the bundles 6 continue to deflect after contacting the contacting perimeters 32 of the openings 30, the flexibility of the bundles 6 of the inventive brush 2, as expressed in pounds per inch of deflection, will be at least 50%, more preferably at least 67%, of the flexibility of the bundles of an otherwise identical brush which does not include the inventive guide structure 10.

For each bristle bundle 6 of the inventive brush 2, the size of the support guide opening 30 at the contacting perimeter 32 thereof will preferably be an area which is in the range of from about 150% to about 700% larger than the cross-sectional area of the bundle 6 at the initial bend point 24 and will more preferably be in the range of from about 200% to about 650% larger than the cross-sectional area of the bundle 6. Also, for each bristle bundle 6, the longitudinally outermost contacting perimeter 32 of the support guide opening 30 will preferably be spaced longitudinally outward from the initial bend point 24 of the bundle 6 a distance which is in the range of from about 25% to about 67% of the active length of the bundle 6 and is more preferable in the range of from about 33% to about 60% (more preferably from about 33% to about 50%) of the active length.

Although the support guide openings 30 are shown in the drawings as having a circular shape, it will be understood that the openings 30 can alternatively be oval, square (preferably with rounded corners), triangular with convex sides, or any other desired shape. Further, it will also be understood that the bundles 6 can alternatively have a non-circular cross-sectional shape and that the shape of the guide openings 30 can be the same as or different from the cross-sectional shape of the bundles 6.

The guide plate 10 can be formed of substantially any material which will withstand the temperature conditions and physical stresses to which the guide plate 10 will be subjected when cleaning cooking grates used in outdoor grills. The guide plate 10 will preferably be formed of high temperature nylon or metal and will preferably be a thin metal plate formed of aluminized steel, galvanized steel, or stainless steel of appropriate grade.

Figure 7:
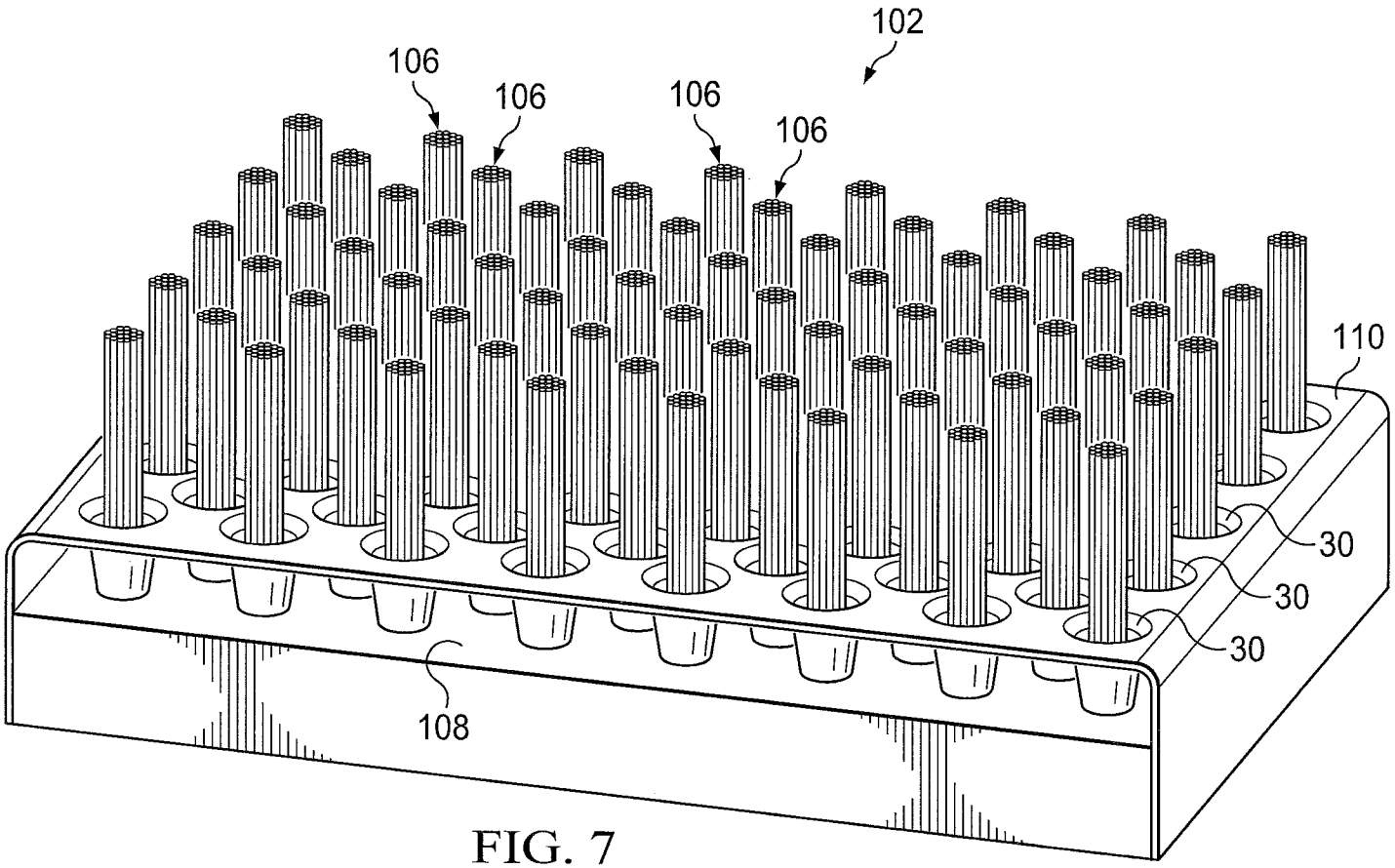
FIG. 7 is a perspective view of an alternative embodiment 102 of the wire bristle brush provided by the present invention.
Figure 8:
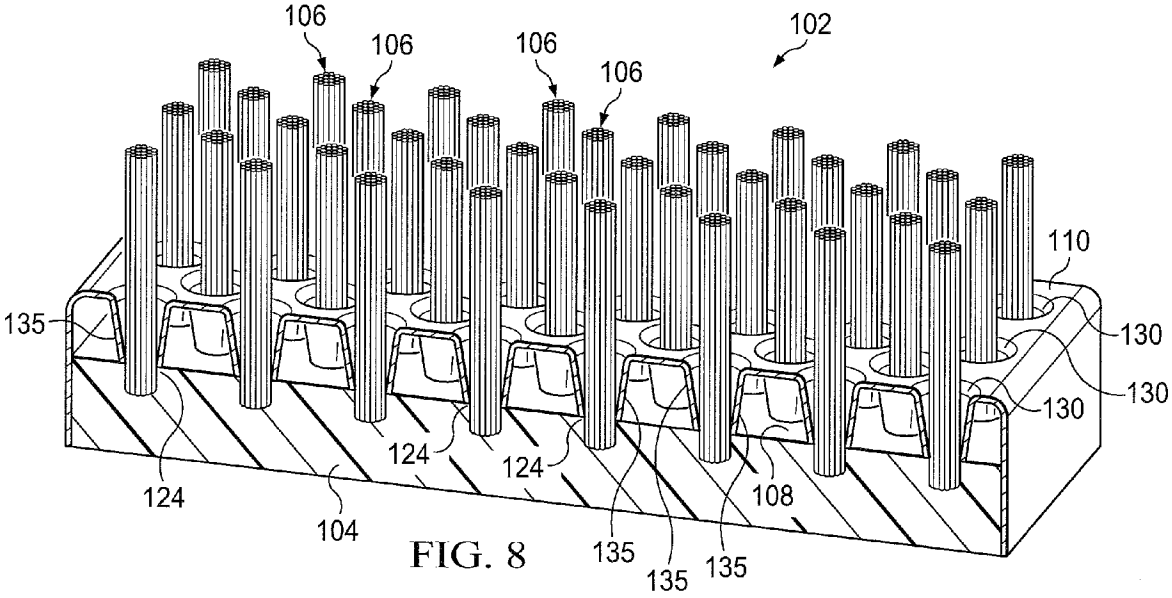
FIG. 8 is a cutaway perspective view of the inventive wire bristle brush 102.
Figure 9:
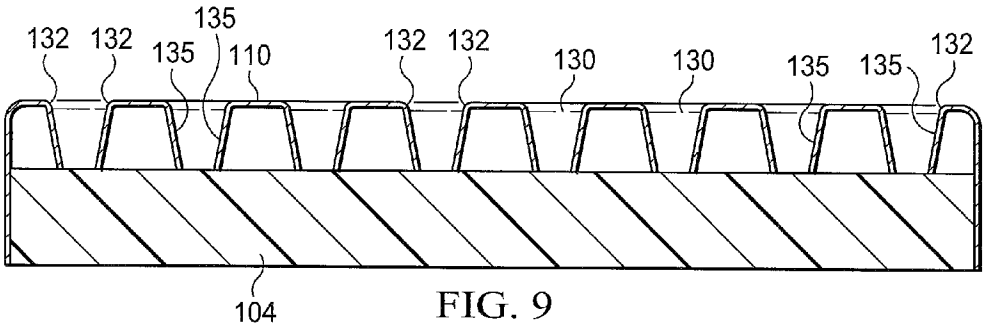
FIG. 9 schematically illustrates a cutaway elevational side view of a retaining base 104 and guide plate 110 assembly used in the inventive brush 102.

Another embodiment 102 of the inventive brush is illustrated in FIGS. 7-9. The structure and preferred specifications of the inventive brush 102 are essentially identical to those of inventive brush 2 except that the guide plate 110 of the inventive brush 102 also includes guide walls 135 which preferably radially surround the bristle bundles 106 and preferably extend at least most, more preferably all or substantially all, of the longitudinal distance from the initial bend point 124 of the bundles 106 (or from the outer surface 108 of the base piece 104 if different) to the longitudinally outermost contacting perimeter 132 of the support guide opening 130.

The guide walls 135, or at least the interior surfaces thereof, can be cylindrical or substantially cylindrical or can otherwise run substantially parallel to the bundles 106 when the bundles 106 are in their non-deflected positions. Alternatively, for at least most, more preferably all or substantially all, of the longitudinal distance from the initial bend point 124 of the bundles 106 (or from the outer surface 108 of the base piece 104 if different) to the longitudinally outermost contacting perimeter 132 of the support guide opening 130, the guide walls 135 can diverge radially outward as they extend longitudinally outward. Such diverging walls 135 can have, for example, a curved shape, a conical shape as illustrated in FIGS. 7-9, or a combination thereof.

The guide plate 110 illustrated in FIGS. 7-9 having conical interior guide walls 135 will provide sufficient stress reversal, stress transfer, or a combination thereof to prevent the wire bristles of the bundles 106 of brush 102 from exceeding there endurance limit at any point along their active length. However, as compared to the guide plate 10 of the inventive brush 2, for some sizes and longitudinal spacings of the support guide openings 130 of the inventive brush 102, the inventive guide plate 110 of the inventive brush 102 may rely to a greater extent, or in some cases entirely, upon stress transfer to prevent the bristles of the bundles 106 from exceeding their endurance limit.

Figure 10:
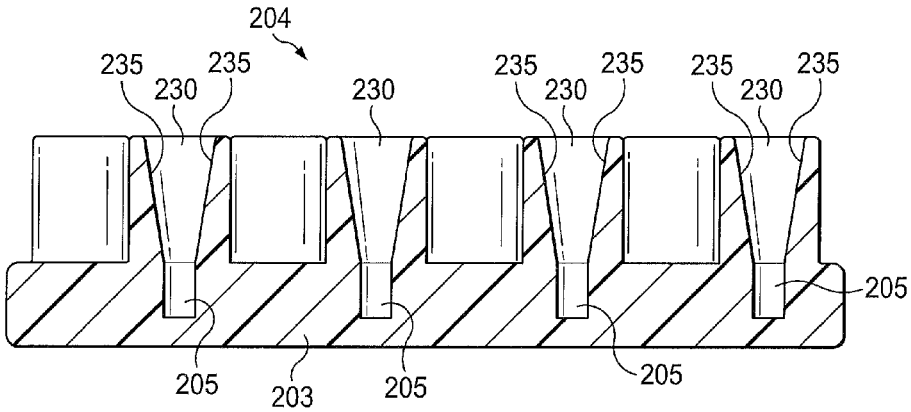
FIG. 10 is a cutaway elevational side view of an alternative combination base piece 204 provided by the present invention.

As opposed to the manufacture and assembly of separate base and guide pieces, FIG. 10 shows an alternative molded, single piece base 204 which corresponds to and includes all of the features of the assembled base and guide pieces 104 and 110 of the inventive brush 102. The molded base piece 204 includes: a lower body portion 203 having holes 205 formed therein for tightly receiving and retaining the proximal base portions of the bristle bundles; guide walls 235 having conical interiors which diverge radially outward as they extend longitudinally outward from the holes 205; and outer guide openings 230. The molded single piece base 204 can be formed of any material which will withstand the temperature conditions and physical stresses to which the base piece 204 will be subjected when cleaning cooking grates used in outdoor grills. The molded single piece base 204 will preferably be formed of glass-reinforced, heat stabilized nylon.

Figure 11:
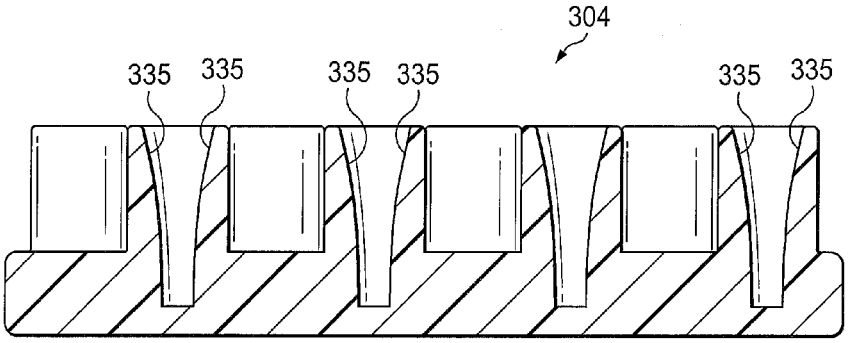
FIG. 11 is a cutaway elevational side view of an alternative combination base piece 304 provided by the present invention.

Another embodiment 304 of the molded single piece base provided by the present invention is illustrated in FIG. 11. The single piece base 304 is substantially identical to the inventive single piece base 204 except that the interior guide walls 335 of the base 304 are not conical. Rather, the guide walls 335 of the base piece 304 diverge radially in a curved manner as they extend longitudinally outward.

Figure 12:
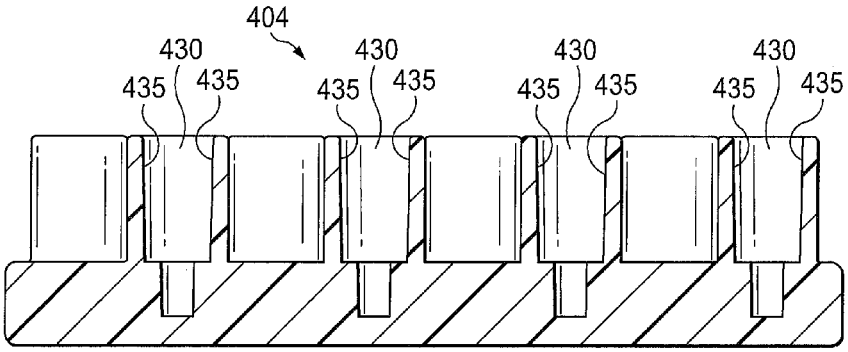
FIG. 12 is a cutaway elevational side view of an alternative combination base piece 404 provided by the present invention.

Another embodiment 404 of the molded single piece base provided by the present invention is illustrated in FIG. 12. The single piece base 404 is also substantially identical to the inventive single piece base 204 except that the interior guide walls 435 of the base 404 are cylindrical walls having the support guide openings 430 at the outer ends thereof. For at least most or all of their longitudinal length, the cylindrical guides will preferably have an internal cross-sectional area which will be from about 150% to about 700%, more preferably from about 200% to about 650%, larger than the cross-sectional areas of the bristle bundles at their initial bend points. The balance between stress reversal versus stress transfer provide by the inventive single piece base 404 will correspond more to the balance provided by the guide plate 10 of the inventive brush 2, as compared to the balance between stress reversal versus transfer provided by the guide plate 110 of the inventive brush 102.

The following examples are intended to illustrate, but in no way limit, the present invention.

EXAMPLES

Brush tests were conducted using a repetitive motion tester which applied a given vertical load to the brush and moved it back and forth across a sample of a typical cast iron grate. A single combined back and forth movement of the brush is referred to herein as a "cycle." For each brush, five successive 10,000 cycle tests were performed with a count of the broken bristles being conduct after each of the five 10,000 cycle segments.

With a standard prior art stainless steel wire brush of typical manufacture, when a 4.8 lb. vertical load was applied, 109 failures (i.e., broken bristles) were counted after the first 10,000 cycles, 261 additional failures after the next 10,000 cycles, 82 additional failures after the following 10,000 cycles, 44 additional failures after the next 10,000 cycles, and 57 additional failures after the last 10,000 cycles. All failed bristles were measured to be at their active length of 0.75 inches, indicating each failure occurred at the point where the bristle bundle exited the blind hole in the base support.

Given that the prior art brush had a total of 5,700 individual bristles grouped together in 95 bundles, the total breakage of 553 bristles constituted a failure rate of almost 10%.

When an identical prior art brush was tested under a higher vertical load of 5.9 lbs., 1860 (32%) of the bristles had failed by the end of just 10,000 cycles.

Given that the typical vertical load on the brush during actual use has been measured to be in the range of from 4 to 8 lbs., this result exemplified the failure patterns and pour performance of the prior art brushes as experienced during actual use.

Tests were then conducted using the same type of prior art brush but with the bristles shortened to half their active length (i.e., the bristles were shortened from 0.75 in to an active length of 0.375 in). This resulted in an order of magnitude reduction in failures with the same vertical load. However, the brush bristles then lacked the flexibility needed to fully clean irregular food contacting surfaces and took on more of the nature of a fixed scraper.

An inventive brush 2 as illustrated in FIGS. 2-3 was then tested. The inventive brush 2 had the same active bristle length (0.75 inches) and bundle size as the prior art wire brush. However, the inventive brush 2 also had a guide plate 10 installed thereon having bundle support guide openings 30 which were 0.20 inch in diameter and were space 0.384 inches from the surface 8 of the base piece 4. In addition, the inventive brush 2 had: a wire bundle 6 diameter of 0.08 in; a wire bundle 6 cross-sectional area at the initial bend point 24 of 0.005 $in^2$; a support guide opening 30 area of 0.0314 $in^2$; a ratio of guide opening 30 area to bundle 6 cross-sectional area of 6.28; and a ratio of the distance of the guide openings 30 from the base 4 versus the active length of the bundles 6 of 0.512 (i.e., 51.2%).

The inventive brush 2 had zero failures after 50,000 total cycles under a vertical load of 4.8 lb. The inventive brush 2 was then subjected to an additional 10,000 cycle test at a vertical load of 5.9 lb. and had only one bristle failure and then tested for 40,000 more cycles at a vertical load of 5.9 lb. with only two more bristle failures.

Thus, the present invention is well adapted to carry out the objects and attain the ends and advantages mentioned above as well as those inherent therein. While presently preferred embodiments have been described for purposes of this disclosure, numerous changes and modifications will be apparent to those of ordinary skill in the art. Such changes and modifications are encompassed within this invention as defined by the claims.

What is claimed is:

1. A wire bristle brush for back and forth brushing movement comprising:

a retaining base;

one or more bundles of wire bristles, each said bundle comprising a proximal end portion which is retained in fixed position by said retaining base and a projecting active portion having an active length which extends longitudinally from an initial bend point of said bundle to a distal end of said bundle, said active length of said bundle is from about 0.5 to about 1.5 inches, said initial bend point is located substantially at an outer surface of said retaining base, and said bundle having a cross-sectional area at said initial bend point of from about 0.002 to about 0.013 $in^2$; and a deflection support guide for each said bundle comprising a support guide opening through which said bundle projects, said support guide opening having a longitudinally outermost contacting perimeter which surrounds said bundle for contacting said active portion of said bundle when said bundle flexes during said back and forth brushing movement, wherein said longitudinally outermost contacting perimeter of said support guide opening is spaced longitudinally outward from said initial bend point of said bundle a longitudinal distance which is in a range of from 25% to 67% of said active length of said bundle, said support guide opening has an opening area at said longitudinally outermost contacting perimeter which is from about 150% to about 700% larger than said cross-sectional area of said bundle at said initial bend point, said distal end of each said bundle has an intermediate deflection point corresponding to a degree of bending of said bundle at which said bundle initially contacts said outermost contacting perimeter of said support guide opening as said wire bristle brush moves in a direction of travel during said back and forth brushing movement, wherein, at said intermediate deflection point, said distal end of said bundle is deflected in a direction opposite said direction of travel and said bundle is bent at said initial bend point in said direction opposite said direction of travel, and said distal end of each said bundle has a further deflection point as said wire bristle brush moves in said direction of travel wherein said bundle remains in contact with said outermost contacting perimeter of said support guide opening, said further deflection point of said distal end of said bundle is beyond said intermediate deflection point of said distal end of said bundle in said direction opposite said direction of travel, and said further deflection point is at or beyond a point of stress reversal of said bundle at said initial bend point so that, when said distal end of said bundle is at said further deflection point, said bundle is bent at said initial bend point in said direction of travel.

2. The wire bristle brush of claim 1 wherein for each said bundle:

said longitudinally outermost contacting perimeter of said support guide opening is spaced longitudinally outward from said initial bend point of said bundle a distance which is in a range of from 33% to 60% of said active length of said bundle; and said support guide opening at said longitudinally outermost contacting perimeter is from 200% to 650% larger than said cross-sectional area of said bundle at said initial bend point.

3. The wire bristle brush of claim 1 wherein for each said bundle, said deflection support guide comprises said support guide opening being formed in a plate spaced longitudinally outward from said initial bend point.

4. The wire bristle brush of claim 1 wherein for each said bundle, said deflection support guide comprises an interior wall which radially surrounds said bundle from said initial bend point to said longitudinally outermost contacting perimeter of said support guide opening.

* * * * *